US006589440B2

(12) United States Patent
Atwill

(10) Patent No.: US 6,589,440 B2
(45) Date of Patent: Jul. 8, 2003

(54) WATERLESS URINAL WITH LIQUID SEAL, LIQUID SEAL AND METHOD OF USING LIQUID SEAL

(76) Inventor: John Atwill, 15600 New Century Ave., Gardena, CA (US) 90248

( * ) Notice: Subject to any disclaimer, the term of this patent is extended or adjusted under 35 U.S.C. 154(b) by 0 days.

(21) Appl. No.: 09/925,853

(22) Filed: Aug. 9, 2001

(65) Prior Publication Data

US 2002/0038474 A1 Apr. 4, 2002

Related U.S. Application Data

(60) Provisional application No. 60/224,813, filed on Aug. 11, 2000.

(51) Int. Cl.[7] ..... C09K 3/00; C02F 1/00; A47K 11/12; A62D 5/00

(52) U.S. Cl. ..... 252/58; 252/62.3 Q; 252/1; 252/366; 252/186.1; 4/301; 4/309; 4/311; 4/679; 4/114.1; 4/DIG. 11; 4/303; 137/247.11; 137/247.27

(58) Field of Search ..... 4/114.1, 301, 302, 4/303, 309, 310, 311, 462, 679, 681, DIG. 11, 288, 290, 292, 293, 306; 137/47, 247.11, 247.27, 247.31, 247.33, 247.35, 247.39, 247.49, 362; 252/1, 186.1, 186.42, 187.1, 187.33, 187.34, 366, 62.3 Q, 58

(56) References Cited

U.S. PATENT DOCUMENTS 1,050,290 A * 1/1913 Posson
3,673,614 A * 7/1972 Claunch ..... 4/10
3,829,909 A * 8/1974 Rod et al. ..... 4/10
4,028,747 A * 6/1977 Newton ..... 4/10
5,093,024 A * 3/1992 Roydhouse ..... 252/186.34
5,117,909 A * 6/1992 Wilton et al. ..... 166/277
5,711,037 A 1/1998 Reichardt et al. ..... 4/301
6,053,197 A * 4/2000 Gorges ..... 137/247.39
6,425,411 B1 * 7/2002 Gorges ..... 137/247.39

* cited by examiner

*Primary Examiner*—Joseph D. Anthony
(74) *Attorney, Agent, or Firm*—John J. Connors; Connors & Associates, Inc.

(57) ABSTRACT

A waterless urinal employs a sealing liquid comprising 4-chloro-3-methylphenol in an amount effective to act as a biocide and a compound selected from the group consisting of (1) branched aliphatic alcohols with $C_{12}$ to $C_{24}$ carbon chain lengths, (2) a mix of the branched aliphatic alcohols and linear aliphatic alcohols with $C_{10}$ to $C_{18}$ carbon chain lengths, (3) a mix of the branched aliphatic alcohols and linear aliphatic fatty acids with $C_{14}$ to $C_{18}$ carbon chain lengths, and (4) a mix of the branched aliphatic alcohols, linear aliphatic alcohols with $C_{10}$ to $C_{18}$ carbon chain lengths, and linear aliphatic fatty acids with $C_{14}$ to $C_{18}$ carbon chain lengths.

16 Claims, 1 Drawing Sheet

WATERLESS URINAL WITH LIQUID SEAL, LIQUID SEAL AND METHOD OF USING LIQUID SEAL

RELATED APPLICATION

This application is a utility application based on U.S. provisional patent application Serial No. 60/224,813, entitled "Waterless Urinal With Unique Liquid Seal, Liquid Seal For Waterless Urinal And Method Of Using The Liquid Seal," filed Aug. 11, 2000. This related application is incorporated herein by reference and made a part of this application.

BACKGROUND OF THE INVENTION

So called waterless urinals are becoming more widely used because of costs savings attributed to conversation of water. These waterless urinals are not flushed with water each time a person uses the urinal. As the waterless urinal is repeatedly used, urine is collected in a compartment of the urinal. An oily sealing liquid that is immiscible with the urine and is lighter than the urine covers the collected urine. This oily sealing liquid floats on the surface of the urine, serving as a barrier that prevents odors from the urinal escaping to the environment. Typically, such waterless urinals include a removable cartridge having a top with an opening therein in communication with the compartment holding an initial water charge that mixes with urine flowing into the compartment through the opening. A stand pipe type drain is in communication with the compartment that allows the compartment to be drained continually to a sewer or other waste disposal system as the compartment is filled with urine. U.S. Pat. No. 5,711,037 is illustrative of a typical waterless urinal.

SUMMARY OF THE INVENTION

It has been proposed that a biocide be added to the sealing liquid to kill bacteria. One such biocide is an aromatic halogen compound, for example, a chloro-phenol compound, in particular 4-chloro-3-methylphenol. The 4-chloro-3-methylphenol is especially desirable because it kills a broad spectrum of bacteria. The problem with using this biocide is that, when combined the straight, that is linear, aliphatic alcohols commonly used as the sealing liquid, a very foul odor occurs that is not easily masked with a fragrance. This problem is especially acute when the 4-chloro-3-methylphenol is added to decanol, one of the most widely used sealing liquids.

This invention overcomes this odor problem and has several features, no single one of which is solely responsible for its desirable attributes. Without limiting the scope of this invention as expressed by the claims that follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include, but are not limited to, providing a sealing liquid having the following characteristics:

(1) It is odorless, or at least be capable of having an unpleasant odor masked with a fragrance.

(2) It is liquid at ambient temperatures.

(3) It floats on water, urine, or a mixture of water and urine.

(4) It is miscible with biocides, particularly chloro-phenol type biocides, and does not produce the foul odor when such a biocide is included.

(5) It resist being dissolved by detergents commonly used in cleaning wash rooms.

This invention provides a new composition useful as a sealing liquid for waterless urinals, a method of using this new composition to suppress odors from a waterless urinal, and an improved waterless urinal using this new composition. The new composition comprises a liquid including a biocide and a compound selected from the group consisting of (1) branched aliphatic alcohols with $C_{12}$ to $C_{24}$ carbon chain lengths, (2) a mix of the branched aliphatic alcohols and linear aliphatic alcohols with $C_{10}$ to $C_{18}$ carbon chain lengths, (3) a mix of the branched aliphatic alcohols and linear aliphatic fatty acids with $C_{14}$ to $C_{18}$ carbon chain lengths, and (4) a mix of the branched aliphatic alcohols, linear aliphatic alcohols with $C_{10}$ to $C_{18}$ carbon chain lengths, and linear aliphatic fatty acids with $C_{14}$ to $C_{18}$ carbon chain lengths.

The biocide is an aromatic halogen compound, preferably a chloro phenol compound such as, for example, 4-chloro-3-methylphenol. The biocide is from about 0.1 to about 5 weight percent of the liquid, preferably from 1 to 3 weight percent of the liquid.

The branched alcohols are 2-alkyl-alkanols. The preferred 2-alkyl-alkanols are selected from the group consisting of 2-butyloctanol, 2-butyldecanol, 2-hexyloctanol, 2-hexyldecanol, 2-octyldecanol, 2-hexyldodecanol, 2-octyldodecanol, and mixtures thereof. The linear alcohols are selected from the group consisting of 1-decanol, 1-dodecanol, 1-tetradecanol, and 1-hexadecanol. The linear aliphatic fatty acids are selected from the group consisting of n-dodecanoic acid, n-tetradecanoic acid, n-hexadecanoic acid, and n-octadecanoic acid.

The mix of branched alcohols, linear alcohols and linear fatty acids is as follows:

| | Weight Percent Range |
|---|---|
| branched alcohols | 60–100% |
| linear alcohols | 0–40% |
| linear fatty acids | 0–40% |

Optionally, the liquid includes a dye and a fragrance both soluble in the branched alcohols. The dye is from about 0.1 to about 1 weight percent the liquid, and preferably is a blue dye selected from the anthraquinone dye family. The fragrance is from about 0.1 to about 5 weight percent of the liquid and preferably is a lime fragrance, a lemon fragrance, a cherry fragrance, or an almond (benzoate) fragrance. A preferred blend of the dye, fragrance, and biocide comprises from about 2.5 to about 3.5 weight percent of the total weight of the liquid, preferably no more than 5 weight percent of the liquid. Preferably, the dye comprises from about 0.1 to about 0.2 weight percent of the blend, the fragrance comprises from about 1 to about 1.5 weight percent of the blend, and the biocide comprises from about 2 to about 3 weight percent of the blend.

DESCRIPTION OF THE DRAWING

The preferred embodiments of this invention, illustrating all its features, will now be discussed in detail. These embodiments depict the novel and non-obvious waterless urinal of this invention, sealing liquid compositions, and methods of suppressing odors from a waterless urinal as shown in the accompanying drawing, which is for illustrative purposes only. This drawing includes the following figure (FIG.).

DETAILED DESCRIPTION OF THE PREFERRED EMBODIMENTS

Figure 1:
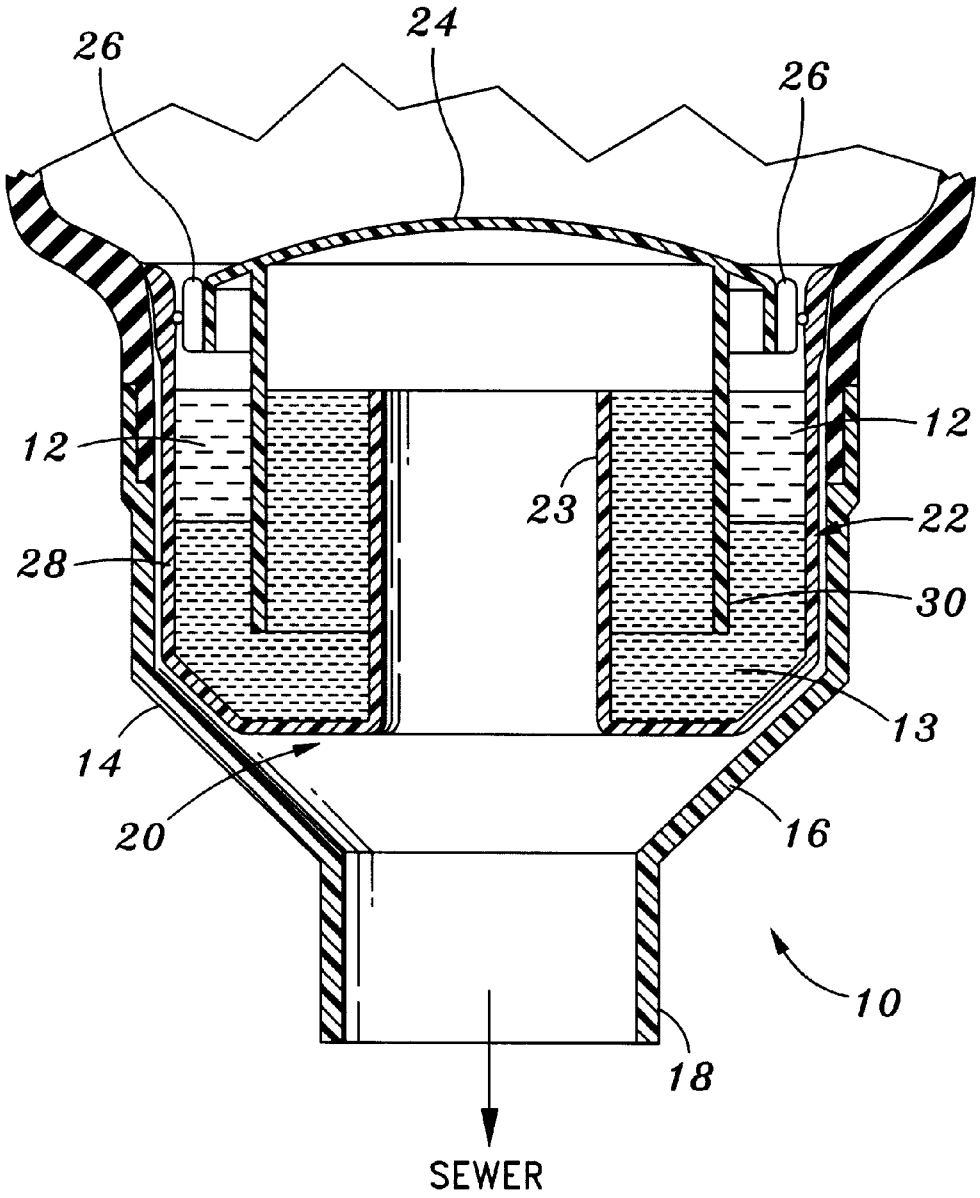
FIG. 1 is a cross-sectional view of a water urinal employing the biocide-sealing liquid mixture of this invention.

As shown in FIG. 1, the waterless urinal 10 of this invention is like that disclosed in U.S. Pat. No. 5,711,037, except it uses the novel sealing liquid 12 of this invention as discussed in detail subsequently. The urinal 10 includes a bowl 14 with a tapered lower portion 16 that has an outlet tube 18 extending therefrom that is connected to a sewer (not shown). There is a cavity 20 in the bowl 14 into which fits a removable cartridge 22. The top 24 of the cartridge rests on the open end of a lower compartment 28 and this top has a number of opening 26 around its periphery. A cylindrical partition wall 30 projects downward from the inside of the top 24 into the compartment 28, and a stand pipe structure 32 projects upward from the bottom of the compartment into the cylindrical partition wall 30.

The sealing liquid 12 forms an annular layer about ⅛ to 1 inch in thickness that floats on top of an initial charge of water 13 or, as the urinal 10 is used, collected urine, or a mixture of water and urine. In accordance with this invention, the liquid 12 includes a biocide and a branched aliphatic alcohol. The following are specific examples of formulations for the liquid 12 where the ingredients are simply mixed together in the percentages set forth in the examples.

EXAMPLE 1

| Ingredient | Weight Percent |
|---|---|
| 2-butyloctanol (Isofol 12 by CONDEA Chemie GmbH) | 96.9 |
| 4-chloro-3-methylphenol (Preventol CMK by Bayer) | 2 |
| lime fragrance (by Lebermuth Company of South Bend Indiana) | 1 |
| liquid oil blue dye (Keystone Pacific Division, Santa Fe Springs, California) | 0.1 |

EXAMPLE 2

| Ingredient | Weight Percent |
|---|---|
| 2-butyloctanol (Isofol 12 by CONDEA Chemie GmbH) | 93.4 |
| 1-hexadecanol | 2 |
| n-octadecanoic acid | 2 |
| 4-chloro-3-methylphenol (Preventol CMK by Bayer) | 2 |
| lime fragrance (by Lebermuth Company of South Bend Indiana) | 1 |
| liquid oil blue dye (Keystone Pacific Division, Santa Fe Springs, California) | 0.1 |

EXAMPLE 3

| Ingredient | Weight Percent |
|---|---|
| 2-butyloctanol (Isofol 12 by CONDEA Chemie GmbH) | 64.9 |
| 1-decanol | 28 |
| 1-hexadecanol | 2 |
| n-octadecanoic acid | 2 |
| 4-chloro-3-methylphenol (Preventol CMK by Bayer) | 2 |
| lime fragrance (by Lebermuth Company of South Bend Indiana) | 1 |
| liquid oil blue dye (Keystone Pacific Division, Santa Fe Springs, California) | 0.1 |

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A method of suppressing odors from a waterless urinal including a compartment holding urine, wherein a liquid that floats on the urine is placed in said compartment, said liquid including a biocide comprising an aromatic halogen compound and a compound selected from the group consisting of (1) branched aliphatic alcohols with $C_{12}$ to $C_{24}$ carbon chain lengths, (2) a mix of branched aliphatic alcohols with $C_{12}$ to $C_{24}$ carbon chain lengths and linear aliphatic alcohols with $C_{10}$ to $C_{18}$ carbon chain lengths, (3) a mix of branched aliphatic alcohols $C_{12}$ to $C_{24}$ carbon chain lengths and linear aliphatic fatty acids with $C_{14}$ to $C_{18}$ carbon chain lengths, (4) a mix of branched aliphatic alcohols with $C_{12}$ to $C_{24}$ carbon chain lengths, linear aliphatic alcohols with $C_{10}$ to $C_{18}$ carbon chain lengths, and linear aliphatic fatty acids with $C_{14}$ to $C_{18}$ carbon chain lengths.

2. The method according to claim 1 where the branched alcohols are selected from the group consisting of 2-butyloctanol, 2-butyldecanol, 2-hexyloctanol, 2-hexyldecanol, 2-octyldecanol, 2-hexyldodecanol, 2-octyldodecanol, and mixtures thereof.

3. The method according to claim 1 where (a) the linear alcohols are selected from the group consisting of 1-decanol, 1-dodecanol, 1-tetradecanol, and 1-hexadecanol, and (b) the linear aliphatic fatty acids are selected from the group consisting of n-dodecanoic acid, n-tetradecanoic acid, n-hexadecanoic acid, and n-octadecanoic acid.

4. The method according to claim 1 where the branched alcohols are 2-alkyl-alkanols.

5. The method according to claim 1 where the biocide is from 0.1 to 5 weight percent of the liquid.

6. The method according to claim 1 where the mix of branched alcohols, linear alcohols, and linear fatty acids comprises from 60 to 100 weight percent branched alcohols, and from 0 to 40 weight percent linear alcohols, and from 0 to 40 weight percent of the linear fatty acids.

7. The method according to claim 1 where the aromatic halogen compound is 4-chloro-3-methylphenol.

8. The method according to claim 7 where the branched aliphatic alcohol is 2-butyloctanol.

9. The method according to claim 8 where the liquid includes a dye that is soluble in the liquid.

10. The method according to claim 9 where the dye is from 0.1 to 1 weight percent the liquid.

11. The method according to claim 10 where the dye is a blue dye selected from the anthraquinone dye family.

12. The method according to claim 9 where the liquid includes a fragrance.

13. The method according to claim 12 where the fragrance is from 0.1 to 5 weight percent of the liquid.

14. The method according to claim 13 where the fragrance is a lime fragrance, a lemon fragrance, a cherry fragrance, or an almond fragrance.

15. The method according to claim 14 the liquid includes a blend of a dye, a fragrance and the biocide, with the blend comprising from 2.5 to 3.5 weight percent of the total weight of the liquid, with the dye comprising from 0.1 to 0.2 weight percent of the blend, the fragrance comprising from 1 to 1.5 weight percent of the blend, and the biocide comprising from 2 to 3 weight percent of the blend.

16. A method of suppressing odors from a waterless urinal including a compartment holding urine, wherein a liquid that floats on the urine is placed in said compartment, said liquid including 4-chloro-3-methylphenol in an amount effective to act as a biocide and a compound selected from the group consisting of (1) branched aliphatic alcohols with $C_{12}$ to $C_{24}$ carbon chain lengths, (2) a mix of branched aliphatic alcohols with $C_{12}$ to $C_{24}$ carbon chain lengths and linear aliphatic alcohols with $C_{10}$ to $C_{18}$ carbon chain lengths, (3) a mix of branched aliphatic alcohols with $C_{12}$ to $C_{24}$ carbon chain lengths and linear aliphatic fatty acids with $C_{14}$ to $C_{18}$ carbon chain lengths, (4) a mix of branched aliphatic alcohols with $C_{12}$ to $C_{24}$ carbon chain lengths, linear aliphatic alcohols with $C_{10}$ to $C_{18}$ carbon chain lengths, and linear aliphatic fatty acids with $C_{14}$ to $C_{18}$ carbon chain lengths.

* * * * *